US007331371B1

(12) United States Patent
Kovach et al.

(10) Patent No.: US 7,331,371 B1
(45) Date of Patent: Feb. 19, 2008

(54) TWIST RELEASE SAFETY STOP BALL FOR WINDOW COVERING CORD

(75) Inventors: Joseph Kovach, Brighton, CO (US); Jason Throne, Rockport, ME (US); Kevin Dann, Denver, CO (US); James Anthony, Denver, CO (US)

(73) Assignee: Hunter Douglas Inc, Upper Saddle River, NJ (US)

( * ) Notice: Subject to any disclaimer, the term of this patent is extended or adjusted under 35 U.S.C. 154(b) by 100 days.

(21) Appl. No.: 11/279,590

(22) Filed: Apr. 13, 2006

Related U.S. Application Data

(60) Provisional application No. 60/673,182, filed on Apr. 20, 2005.

(51) Int. Cl.
*E06B 9/00* (2006.01)

(52) U.S. Cl. ..... 160/178.1 R; 24/115 F

(58) Field of Classification Search ..... 160/178.1 R, 160/168.1 R, 173 R, 84.04; 24/115 F, 115 M; 16/114.1, 441, 442
See application file for complete search history.

(56) References Cited

U.S. PATENT DOCUMENTS

| | | | | |
|---|---|---|---|---|
| 3,633,646 | A * | 1/1972 | Zilver | 160/168.1 R |
| 4,909,298 | A | 3/1990 | Langhart et al. | |
| 5,715,884 | A * | 2/1998 | Cotten | 24/115 A |
| 6,044,523 | A * | 4/2000 | Ortega | 16/442 |
| 6,263,946 | B1 * | 7/2001 | Cotten | 160/178.1 R |

* cited by examiner

*Primary Examiner*—Brian E. Glessner
*Assistant Examiner*—Candace L. Bradford
(74) *Attorney, Agent, or Firm*—Camoriano and Associates; Theresa Fritz Camoriano; Guillermo Camoriano

(57) ABSTRACT

A safety stop ball includes a post and a nut which travels along a spiral path relative to the post. The nut and the post are biased toward each other to retain the ends of lift cords. As the nut is displaced relative to the post, the lift cords are released.

11 Claims, 5 Drawing Sheets

TWIST RELEASE SAFETY STOP BALL FOR WINDOW COVERING CORD

This application claims priority from U.S. Provisional Application Ser. No. 60/673,182 filed Apr. 20, 2005.

BACKGROUND OF THE INVENTION

The present invention relates to a safety stop ball for use with a control cord of a window covering. More particularly, it relates to a stop ball wherein the lift cords of the window covering are readily assembled to the ball, which releases the lift cords when an object pushes against the top of the stop ball.

SUMMARY OF A PREFERRED EMBODIMENT

A plurality of cords (referred to herein as lift cords) enters the stop ball, and a single control cord exits the stop ball. By pulling on the single control cord or the stop ball housing, a person is effectively pulling on the plurality of lift cords as well, thereby raising or lowering the window covering. However, if an object (such as a child's neck or head) is inserted in between the lift cords, and the object is then moved toward the stop ball, pushing against the lift cords or the top lid of the stop ball, the lift cords are released, thereby eliminating a hanging or choking hazard.

It should be noted that an object entangled in the lift cords need not necessarily come in contact with the top lid of the stop ball in order for the stop ball to release the lift cords. As the object approaches the top lid, the lift cords are pulled apart, and the lift cords themselves push down on the top lid to release the lift cords from the stop ball. This feature is effective even if the lift cords become crossed above the lid of the stop ball. An object entangled in the lift cords pulls them apart, and the lift cords then apply a downward pressure on the top lid in order to release the lift cords from the stop ball.

In a preferred embodiment, a post, including a post head or flange, is secured to a housing, and a nut is biased against the post head by a spring. The nut travels in a helical path relative to the post from an engaged position to a released position. In the engaged position, cavities on the post head align with corresponding cavities on the nut such that, when the nut is pressed against the post head, the aligned cavities trap enlargements at the ends of the lift cords, thereby retaining the lift cords on the stop ball. If a person pulls on the post or the housing which is secured to the post, he is also pulling on the lift cords. A control cord is secured to the post such that the control cord may be pulled to actuate all the lift cords via the safety stop ball.

A housing cover, or lid, lies atop the housing and contacts the nut. The lift cords enter the stop ball through openings in the lid. Pushing inwardly on the lid also pushes on the nut (against the biasing force of the spring) to unscrew the nut away from the post head, moving the nut to the released position. The unscrewing of the nut away from the post head separates the cavities on the nut from the cavities on the post and thereby opens up the retaining cavities that were housing the enlarged ends of the lift cords, such that the enlarged ends slip out of the retaining cavities, allowing the lift cords to pull out of the stop ball through the openings in the lid. One of the lift cords is fixed to the stop ball and remains attached to the stop ball to prevent it from coming loose and becoming a choking hazard.

DESCRIPTION

Figure 1:
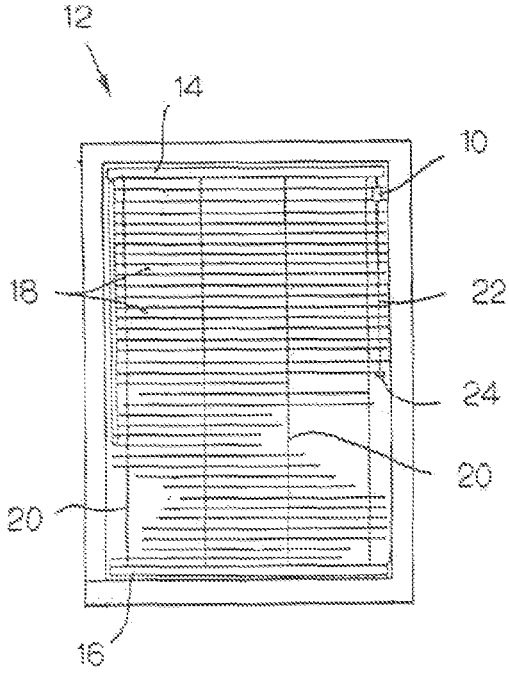
FIG. 1 is a front view of a window covering in the fully lowered position, with a stop ball made in accordance with the present invention.

FIGS. 1-7A depict a safety stop ball 10 made in accordance with the present invention. Referring to FIGS. 1-4, a window covering 12, such as a blind, includes a top rail 14, a bottom rail 16, and a plurality of slats 18 suspended from the top rail 14 via lift cords 20. The lift cords 20 extend from the bottom rail 16, through the slats 18, and through the top rail 14, and exit at the right hand side of the top rail 14. The individual lift cords 20 enter, and are attached to, the stop ball 10. A single control cord 22, also attached to the stop ball 10, exits the stop ball 10. The control cord 22 typically ends in a tassel 24.

Figure 2:
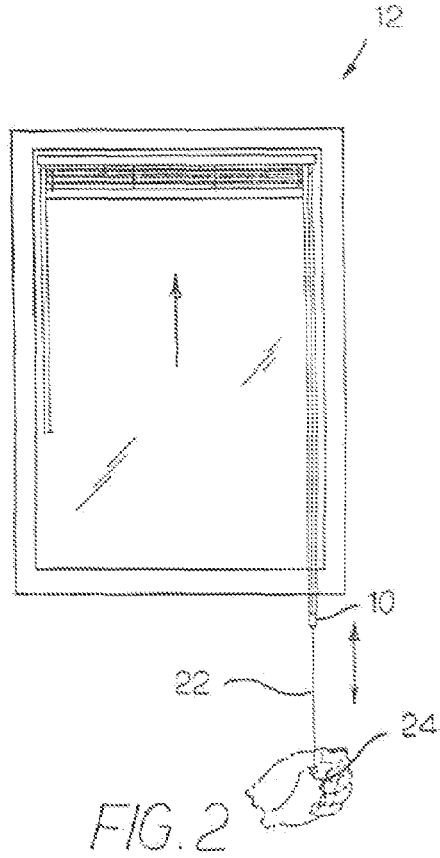
FIG. 2 is a front view of the window covering of FIG. 1, but in the fully raised position.

As shown in FIG. 2, a user may pull on the control cord 22 to raise the slats 18 of the window covering 12. (In some known window coverings, pulling on the lift cords lowers the window covering, and this stop ball could be used in those coverings as well.) Pulling on the control cord 22 pulls on the stop ball 10, which also pulls on all the lift cords 20, such that the single control cord 22 actuates all the lift cords 20 via the stop ball 10.

Referring briefly back to FIG. 1, when the window covering 12 is extended (the bottom rail 16 is in its fully lowered position), the stop ball 10 is proximate the top rail 14 and stops the lift cords 20 from disappearing into the top rail 14, thus also stopping the further lowering of the bottom rail 16. In this position, the stop ball 10 is at its highest elevation, and the lift cords 20 only extend slightly beyond the top rail 14 before entering the stop ball 10.

Figure 3:
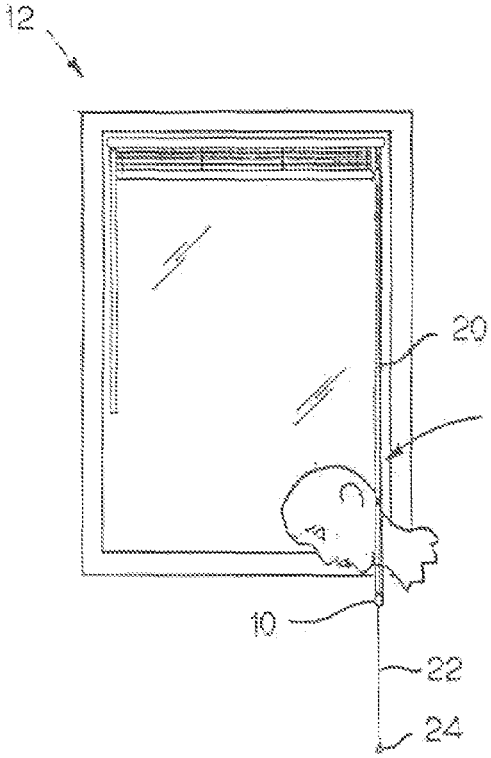
FIG. 3 is a broken-away, perspective view of the window covering of FIG. 2, schematically showing a person's neck inserted between the lift cords of the window covering.
Figure 4:
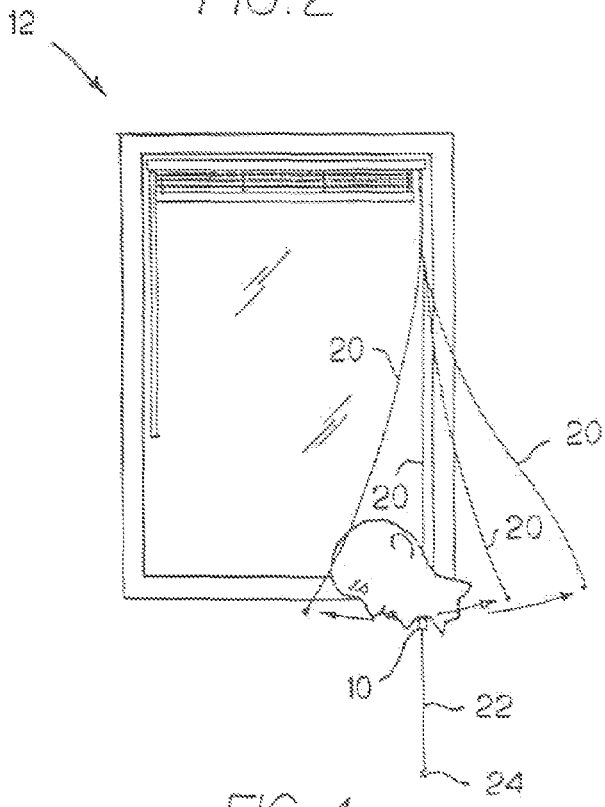
FIG. 4 is the same view FIG. 3, but with the neck having pushed down on the safety stop ball, releasing the lift cords.

As seen in FIG. 3, when the window covering 12 is raised (partially or fully retracted, as shown in FIGS. 2-4), the stop ball 10 is at a lowered position, and the lift cords 20 hang such that it is possible for something (such as a child's, or a pet's, head or neck) to become entangled in the lift cords 20. Should this happen, as the object contacts the top of the stop ball 10, the stop ball automatically releases the lift cords 20 to eliminate the risk of hanging or strangling, as is explained in more detail below. Also, as noted earlier, the object need not contact the top of the stop ball 10 for the lift cords 20 to be released from the stop ball 10. The force exerted by the object against the lift cords 20, especially as the object approaches the stop ball 10, results in the lift cords 20 exerting a force against the top lid 26 of the stop ball 10, which actuates the safety release of the lift cords 20 as discussed in more detail below.

Figure 5:
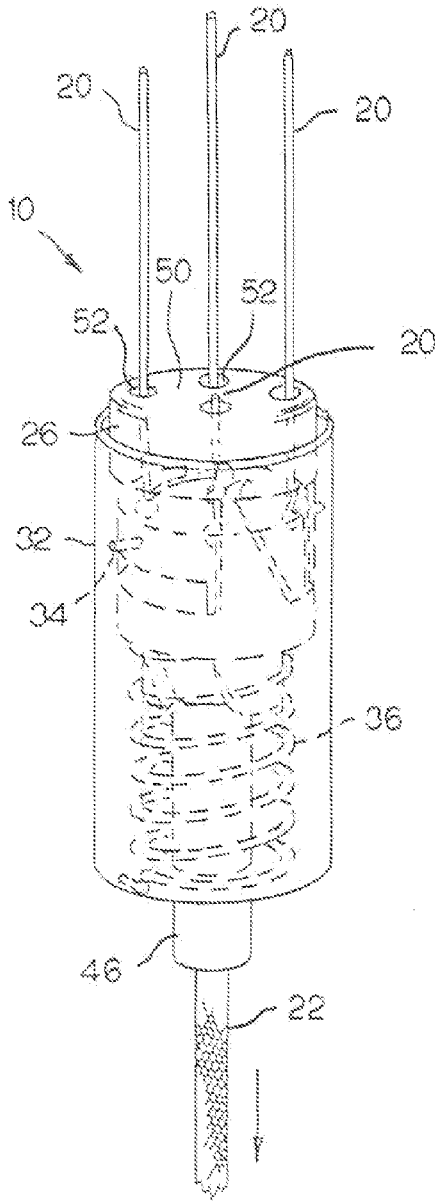
FIG. 5 is a perspective view of the stop ball of FIGS. 1-4, with the internal portions shown in phantom.
Figure 6:
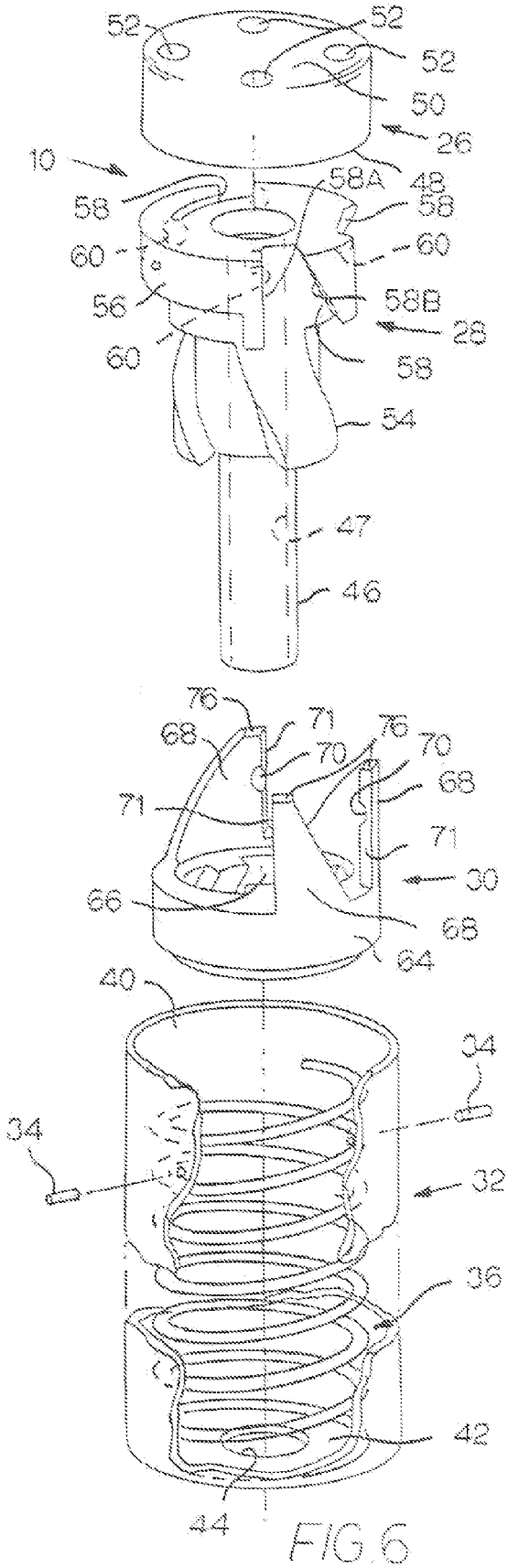
FIG. 6 is an exploded, perspective view of the stop ball of FIG. 5, with the lift cords and the control cord removed for clarity.
Figure 7:
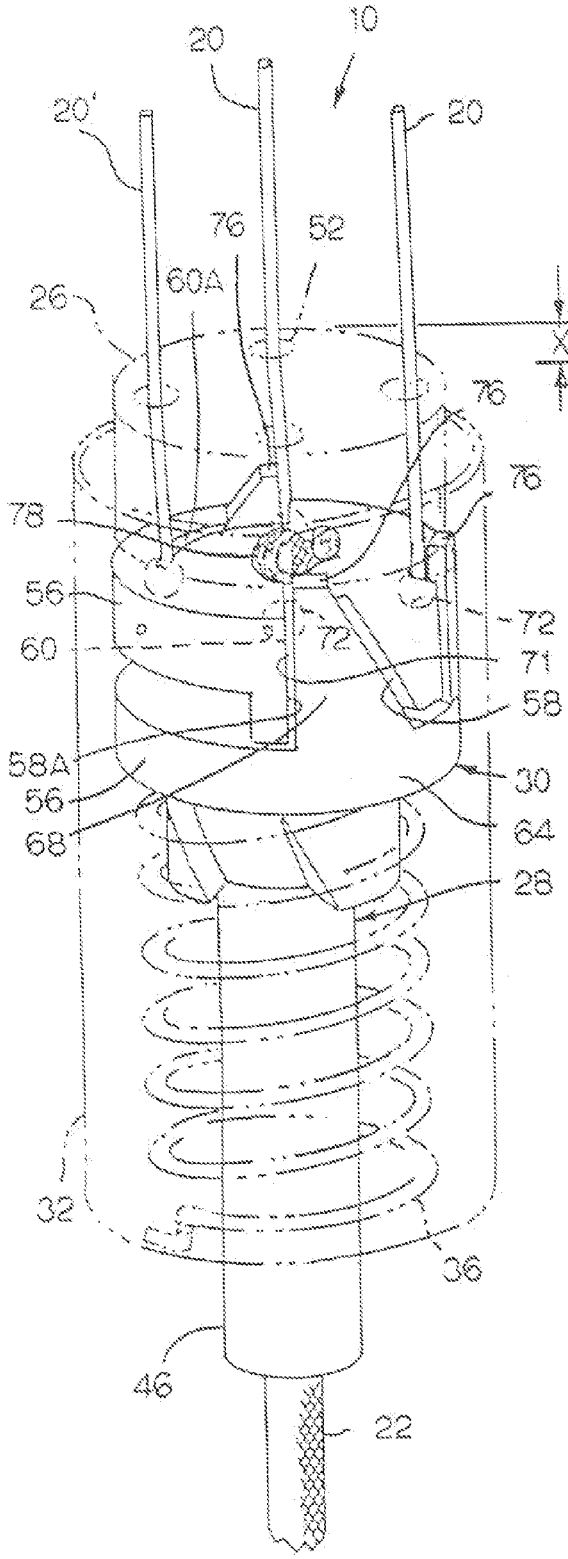
FIG. 7 is a perspective view of the internal elements of the stop ball of FIG. 5 in the assembled position, with the housing and lid shown in phantom.
Figure 7A:
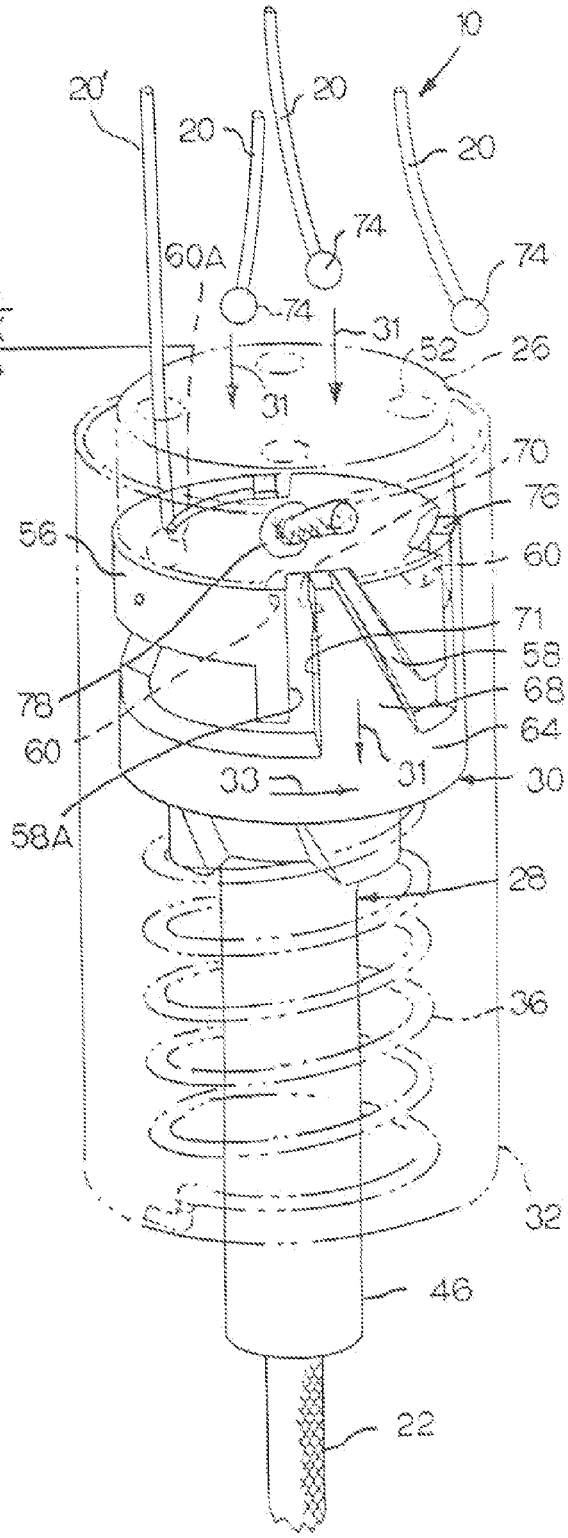
FIG. 7A is the same view as FIG. 7, except that the stop ball is in the safety release position, with the lift cords released from the stop ball.

Referring to FIG. 6, the stop ball 10 includes a lid 26, a post 28, a nut 30, a housing 32, two set screws 34, and a spring 36. The housing 32 is a hollow, substantially cylindrical element with an open top 40 and a substantially closed bottom wall 42 which defines a through opening 44 through which an elongated portion 46 of the post 28 projects, as shown in FIGS. 5 and 7. The lid 26 is a short, hollow cylindrical element with an open bottom 48 and a substantially closed top wall 50, which defines a plurality of through openings 52 through which the lift cords 20 enter the stop ball 10 (See FIG. 5). Each lift cord 20 enters into the interior of the housing 32 through its own respective opening 52 in the lid 26. The outside diameter of the lid 26 is slightly less than the inside diameter of the housing 32, such that the lid 26 slides inside the housing 32, as seen in FIGS. 7 and 7A.

The post 28 includes a hollow, elongated lower portion 46, which defines an internal hollow shaft 47. The upper portion of the post 28 defines a male threaded spiral outer surface 54. The top portion of the post 28 terminates in a head or flange 56, which defines a plurality of substantially triangular indentations 58, each indentation 58 being defined by a substantially vertical wall 58A and an angled wall 58B which is substantially parallel to the upper portion of the spiral surface 54. Each vertical wall 58A itself defines a partial cavity 60, which, when aligned with a similar partial cavity in the nut 30, forms a retaining cavity for receiving the enlarged end of a cord 20. The partial cavity 60 on the post 28 can be seen in FIGS. 6, 7, and 7A. The outside diameter of the head 56 is such that it fits snugly inside the hollow housing 32. Set screws 34 extend through the housing 32 and into the head 56 of the post 28 to fix the post 28 to the housing 32, with the elongated lower portion 46 of the post 28 projecting through the opening 44 in the bottom wall 42 of the housing 32.

The nut 30 includes a ring 64 that defines a female spiral thread 66, which mates with the male spiral thread 54 of the post 28. Projecting upwardly from the top of the ring 64 are triangular extensions 68, which match closely, in number and in shape, the triangular indentations 58 in the post 28. Each of these triangular extensions 68 has a substantially vertical leg 71 which defines a partial cavity 70, which, when the nut 30 and post 28 are in the engaged position, is aligned with its respective partial cavity 60 in its respective vertical wall 58A of the post 28 to form a complete retaining cavity 72 (See FIG. 7). The vertical legs 58A, 71 and their respective partial cavities 60, 70 are aligned, and the assembly is in the engaged position, when the nut 30 is "threaded" onto the post 28 until the ring 64 on the nut 30 abuts the flange 56 of the post 28. (While this embodiment has threads on the post and the nut, the threads could alternatively be on the housing and the nut, since the housing and post are fixed together and function as a unit.)

These complete cavities 72 house enlargements (such as knots or beads 74, See FIG. 7A) at the ends of the lift cords 20, and these enlargements 74 are releasably caught in these cavities 72 by the aligned vertical legs 58A, 71 of the post 28 and the nut 30, respectively. It should be noted in FIG. 6 that there is one cavity 60' which is not formed by aligned indentations in a pair of aligned vertical legs 58A, 71 but rather is formed entirely in the flange 56 of the post 28. The cord end that is received in that cavity 60' remains secured to the post 28 and is not released when the other cord ends are released, so that particular cord is a fixed cord, remaining fixed to the stop ball even after the other cords are released.

To assemble the stop ball 10, a coiled spring 36 is inserted inside the housing 32 and rests against the bottom wall 42 of the housing 32. The nut 30 is placed on top of the spring 36, and the post 28 is inserted through the nut 30 and spring 36 such that the male spiral thread 54 on the post 28 engages the female spiral thread 66 in the nut 30, and the elongated lower portion 46 of the post extends through the spring 36 and projects through the opening 44 in the bottom wall 42 of the housing 32. Relative rotation between the post 28 and the nut 30 during assembly brings the ring 64 of the nut 30 into contact with the head 56 of the post 28 and meshes the triangular extensions 68 of the nut 30 with the respective triangular indentations 58 of the post 28, bringing the post 28 and nut 30 into the engaged position. The spring 36 is then compressed slightly until the set screws 34, which extend through openings in the housing 32, can be tightened into the head 56 of the post 28, securing the housing 32 and the post 28 together. It may be noted that other means for securing the post 28 to the housing 32, such as pins, glue, or even an interference fit between the post 28 and the housing 32, may be used instead of or in addition to the set screws 34. The control cord 22 is fed up through the hollow shaft 47 and out the top of the post 28, and an enlargement, such as a knot 78 is tied to the end of the control cord 22 to secure the control cord 22 to the post 28 as shown in FIGS. 7 and 7A.

Referring to FIG. 7, it may be noted that, when the stop ball 10 is fully assembled, the tops 76 of the triangular extensions 68 of the nut 30 extend above the head 56 of the post 28. The lid 26 rests upon the tops 76 of the triangular extensions 68. The lid 26 may be secured to the tops 76 of the triangular extensions 68, by glue or by snapping on, for instance, or the lid 26 may simply rest on the tops 76 by the force of gravity.

One of the lift cords, labeled 20' in FIGS. 7 and 7A, extends through a narrow vertical slot in the flange 56 of the post 28, and its enlarged end 74 is received in the fixed recess 60', which secures that lift cord 20' to the post 28, making it a fixed cord that will not be released from the stop ball when the other lift cords are released.

To assemble the stop ball 10 to the window covering 12, the lid 26 is pressed downwardly against the post 28, pushing down on the tops 76 of the nut 30, and causing the nut 30 to move downwardly against the upwardly biasing force of the spring 36 to the released position. The nut 30 rotates relative to the post 28 as it moves downwardly, as shown by the arrows 31, 33 of FIG. 7A. The downward component 31 of the displacement is provided by the pressure exerted by the lid pressing down on the tops 76 of the nut 30 as it is pushed toward the post 28. The rotational component 33 of the displacement is provided by the interaction of the mating threads 66, 54 on the nut 30 and the post 28.

The combined downward and rotational displacements 31, 33 of the nut 30 relative to the post 28 cause the triangular extensions 68 of the nut 30 to separate from the triangular indentations 58 of the post 28, as seen in FIG. 7A. The vertical legs 71 of the triangular extensions 68 separate from the vertical legs 58A of the triangular indentations 58, thereby creating a gap between the respective partial cavities 60, 70. The beads 74 of the lift cords 20 are fed through their respective openings 52 in the lid 26, and the bead 74 from each lift cord 20 is inserted into its corresponding partial cavity 60 in the post 28. As the pressure on the lid pushing the lid toward the post 28 is released, the spring 36 biases the nut 30 back up against the head 56 of the post 28 into the engaged position. Once again, the mated threads 66, 54 on the nut 30 and the post 28 define a path that brings the corresponding triangular indentations 58 and triangular extensions 68 back together to form the complete retaining cavities 72, thereby releasably trapping the beads 74 at the ends of the lift cords 20 in these cavities 72.

The same action that is used to assemble the lift cords 20 into the stop ball 10 is also used for automatically releasing the lift cords 20 from the stop ball 10 in case of an emergency. If an object becomes tangled in the lift cords 20, as shown in FIG. 3, and this object pushes down toward the stop ball 10, the object will first contact the lid 26 of the stop ball 10. Pushing down on the lid 26, as discussed above, pushes the nut 30 downwardly against the biasing force of the spring 36 to the released position. As explained above, the nut 30 travels along the path defined by the mated threads and experiences a linear component of displacement 31 as well as a rotational component of displacement 33, resulting in the separation of the triangular indentations 58 and triangular extensions 68 and releasing the beads 74 on the cords 20 from their respective cavities 72, so the cords 20 move upwardly relative to the stop ball 10, and the cord ends 74 pass outwardly through the openings 52 in the lid 26 and are released from the stop ball 10. The fixed cord 20' remains fixed to the post, so there are no loose parts.

Also, as indicated above, it is not necessary for the object to contact the lid 26 in order for the lift cords 20 to be released from the stop ball 10. If the object is entangled in the lift cords 20, as the object approaches the stop ball 10, it pushes the lift cords 20 apart. The lift cords 20 are in contact with the lid 26 as they exit the lid 26 through their respective openings 52. Any force acting to separate the lift cords 20, even if the lift cords 20 are crossed above the lid 26, results in a force acting to move the lid 26 inwardly against the post 28. This force is transmitted by the lid 26 to the nut 30, resulting in the aforementioned rotational separation of the nut 30 from the post 28, to release the lift cords 20.

Figure 8:
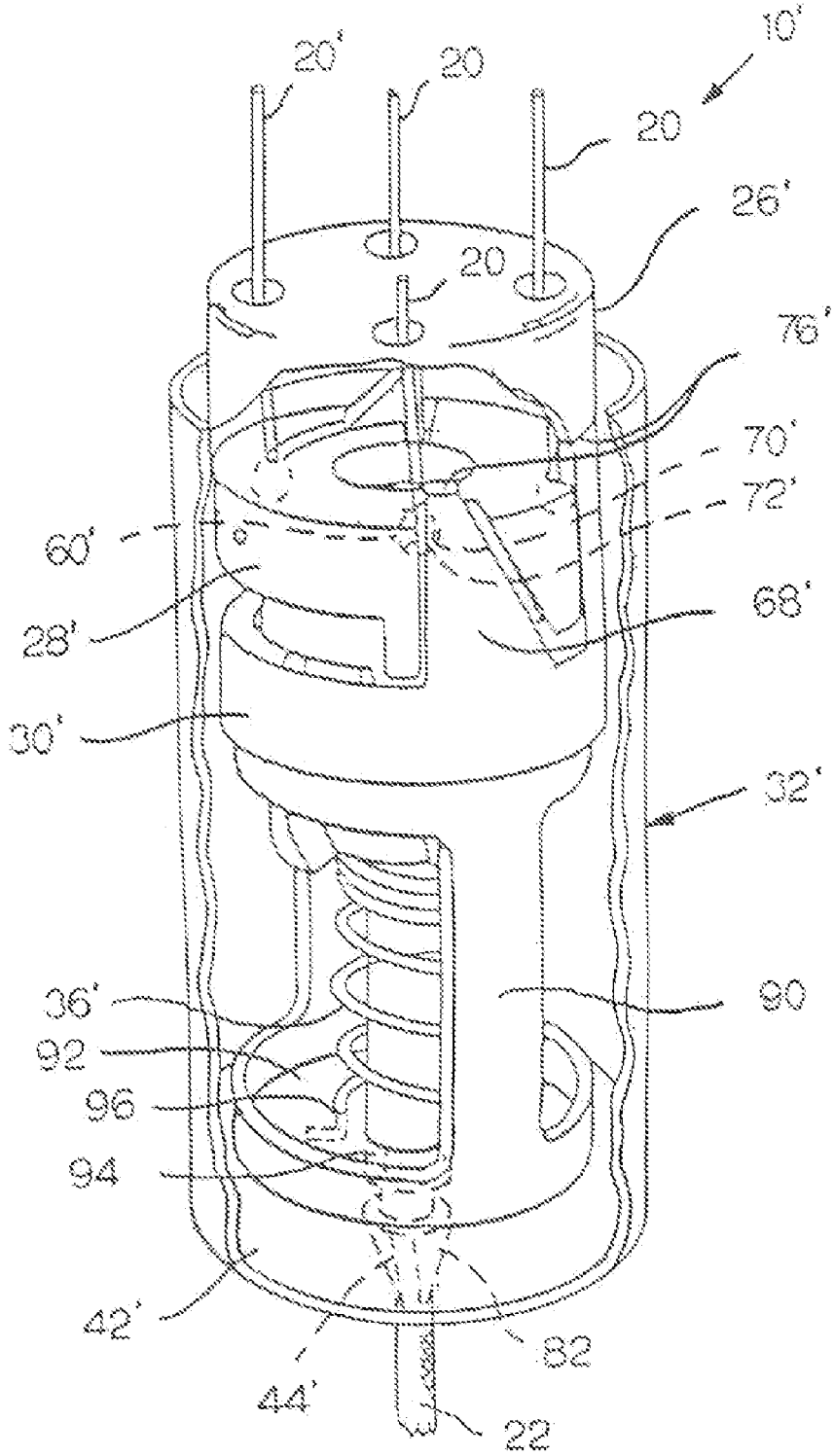
FIG. 8 is a partially broken-away, perspective view of another embodiment of a safety stop ball made in accordance with the present invention.
Figure 9:
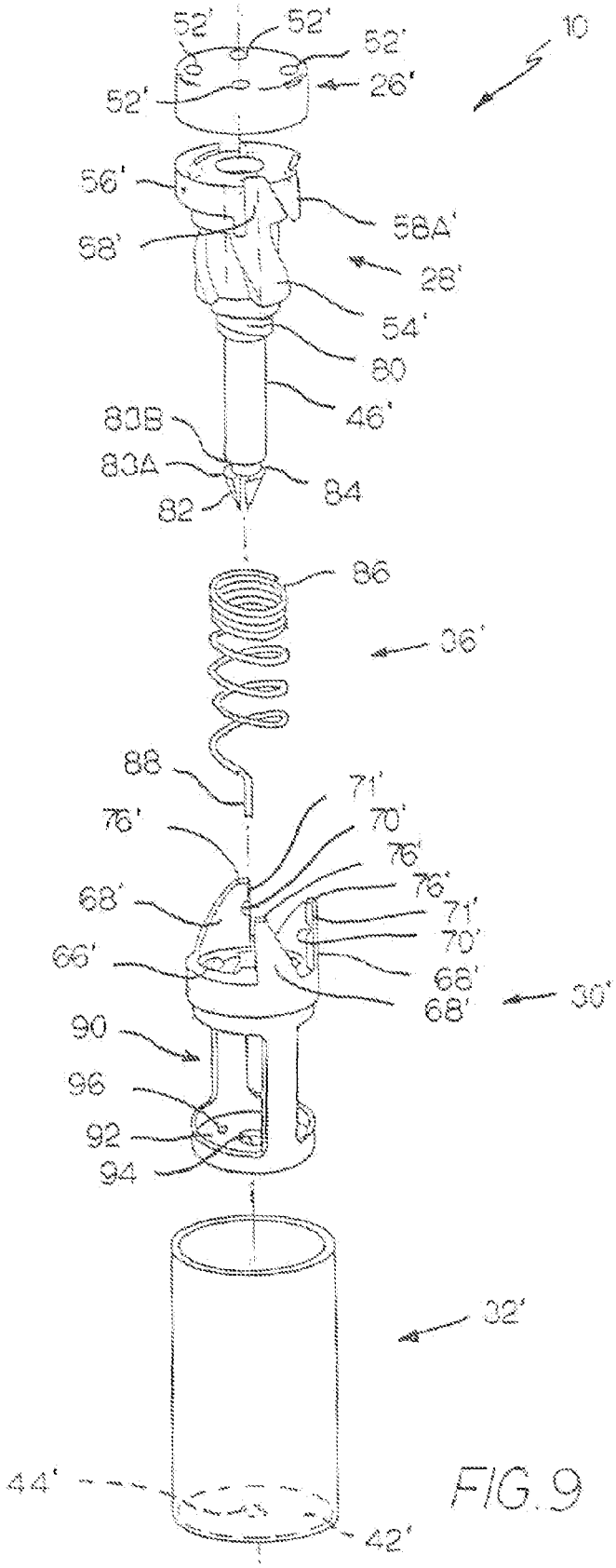
FIG. 9 is an exploded, perspective view of the safety stop ball of FIG. 8, with the lift cords and the control cord removed for clarity.

FIGS. 8 and 9 depict another embodiment of a safety stop ball 10' made in accordance with the present invention. A comparison of this safety stop ball 10' (See FIG. 9) with the safety stop ball 10 disclosed earlier (See FIG. 6) reveals that these two stop balls 10', 10 are quite similar, and in fact operate in a very similar manner. As discussed in more detail below, in both instances, the post is secured to the housing, and the nut, which is biased toward the post, rotationally separates from the post in order to release the lift cords.

Referring to FIGS. 8 and 9, the safety stop ball 10' includes a lid 26', a post 28', a nut 30', a housing 32', and a spring 36'. The post 28' is very similar to the post 28 of the previously described embodiment 10, except that the lower portion 46' includes a threaded portion 80 to secure the spring 36' to the post 28' as described in more detail below. The post 28' also includes a barbed end portion 82 with an annular recess bounded by a lower shoulder 83A and an upper shoulder 83B. As shown in FIG. 8, the barbed end portion 82 extends through the opening 44' in the bottom wall 42' of the housing 32' until the wall of the opening 44' snaps into the annular cavity 84, effectively securing the post 28' to the housing 32'. Once the post 28' is assembled to the housing 32', if the housing 32' is pulled down, its bottom wall 42' impacts against the lower shoulder 83A of the post 28', such that the post 28' moves down together with the housing 32'. Similarly, if the post 28' is pulled down (such as when pulling down on the control cord 22, see FIGS. 7 and 7A) the upper shoulder 83B impacts against the bottom wall 42' of the housing 32', such that the housing 32' again moves down together with the post 28'. This feature eliminates the need for the set screws 34 (See FIG. 6) that were used to secure the post to the housing in the previous embodiment.

The nut 30' is similar to the nut 30 of the previously described embodiment 10, except that it further includes a cage 90 which projects downwardly from the nut 30'. The bottom wall 92 of the cage 90 defines an opening 94 through which the lower portion 46' of the post 28' extends when assembled, as seen in FIG. 8. As described in more detail below, the spring 36' fits inside this cage 90 and biases the nut 30' upwardly toward the post 28'

The spring 36' is similar to the spring 36 of FIG. 6, except that this spring 36' is under tension rather than compression. The first end 86 of the spring 36' is screwed onto the threaded portion 80 of the post 28'. The second end 88 of the spring 36' is secured to the cage 90 of the nut 30' as explained below.

To assemble the safety stop ball 10', the first end 86 of the spring 36' is screwed onto the threaded portion 80 of the post 28'. The lower portion 46' of the post 28' and the spring 36' are inserted through the nut 30', and the second end 88 of the spring 36' is inserted through an opening 96 in the bottom wall 92 of the cage 90. (See FIG. 8.) The second end 88 of the spring 36' is then bent back, as shown in FIG. 8, to secure the spring 36' to the nut 30'. The spring 36' then biases the nut 30' upwardly relative to the post 28' just as the spring 36 of the previous embodiment 10 biases the nut 30 upwardly relative to the post 28. The barb portion 82 of the post 28' projects through the opening 94 in the bottom wall 92 of the cage 90 of the nut 30'.

The subassembly including the post 28', the nut 30' and the spring 36', is then inserted into the housing 32' such that the barb portion 82 extends through the opening 42' in the bottom wall 44' of the housing 32'. As described above, the housing 32' and post 28' snap together so that the bottom wall 44' of the housing 32' is caught between the two shoulders 83A, 83B of the post 28'. Finally, the lid 26' is mounted atop the nut 30' where it rests upon the tops 76' of the triangular extensions 68'. The lid 26' may be secured to the tops 76' of the triangular extensions 68', by glue or by snapping on, for instance, or the lid 26' may simply rest on the tops 76' by the force of gravity.

As was the case for the first embodiment 10, the control cord 22 is secured to the post 28' preferably by feeding the control cord 22 through the hollow passage extending through the post 28' (See item 47 in FIG. 6) and tying off the cord 22 as shown in FIGS. 7 and 7A. Similarly, the beads 74 (See FIG. 7A) on the ends of the lift cords 20 may be inserted into their corresponding cavities in exactly the same manner as described earlier for the first embodiment of the safety stop ball 10, and as reiterated below.

To assemble the stop ball 10' to the window covering 12, the lid 26' is pressed downwardly against the post 28', pushing down on the tops 76' of the nut 30', and causing the nut 30' to move downwardly, away from an engaged position, against the upwardly biasing force of the spring 36', to a released position. The nut 30' rotates relative to the post 28' as it moves downwardly relative to the post 28' as shown by the arrows 31, 33 of FIG. 7A. The downward component 31 of the displacement is provided by the pressure exerted by the lid 26' pressing down on the tops 76' of the nut 30' as it is pushed inwardly. The rotational component 33 of the displacement is provided by the path defined by the mated threads 66', 54'.

The combined downward and rotational displacements 31, 33 of the nut 30' relative to the post 28' cause the triangular extensions 68' of the nut 30' to separate from the triangular indentations 58' of the post 28'. The vertical legs 71' of the triangular extensions 68' separate from the vertical legs 58A' of the triangular indentations 58', thereby creating a gap between the respective partial cavities 60', 70', which opens up the retaining cavities, thus reaching the released position. The beads 74 of the lift cords 20 are fed through their respective openings 52' in the lid 26', and the bead 74 from each lift cord 20 is inserted into its corresponding partial cavity 60' in the post 28'. As the pressure on the lid 26' pushing the lid 26' toward the post 28' is released, the biasing spring 36' moves the nut 30' back up against the head 56' of the post 28'. Once again, the nut 30' traveling along the spiral path defined by the mated threads 66', 54' and brings the corresponding triangular indentations 58' and triangular extensions 68' back together to form the complete retaining cavities 72' in the engaged position, releasably trapping the beads 74 at the ends of the lift cords 20 in these cavities 72'. As with the previous embodiment, it is preferred that one of the lift cords be fixed to the post 28' so it is not released when the other cord or cords are released.

If an object becomes tangled in the lift cords 20, as shown in FIG. 3, and this object pushes down toward the stop ball 10', the object will first contact the lid 26' of the stop ball 10'. Pushing down on the lid 26', as discussed above, pushes the nut 30' downwardly against the biasing force of the spring 36'. As explained above, the nut 30' experiences a linear component of displacement 31 as well as a rotational component of displacement 33, resulting in the separation of the triangular indentations 58' and triangular extensions 68' and releasing the beads 74 on the cords 20 from their respective cavities 72', so the cords 20 move upwardly relative to the stop ball 10', the enlarged cord ends 74 pass out through the openings in the lid, and the cords 20 are released from the stop ball 10'.

As was the case with the previously described embodiment 10, an object entangled in the lift cords 20 need not necessarily contact the lid 26' of the stop ball 10' in order for the lift cords 20 to be released. The entangled object separates the lift cords 20, even if they are crossed above the stop ball 10'. The vertical component of the separating force of the object on the lift cords 20 is transmitted to the lid 26 and thereby also to the nut 30'. This results in the separation of the triangular indentations 58' and triangular extensions 68' and releasing the beads 74 on the cords 20 from their respective cavities 72'.

While these examples are designed for four lift cords, the same concept could be used for fewer or more lift cords. It will be obvious to those skilled in the art that other modifications also may be made to the embodiment described above without departing from the scope of the present invention as defined by the claims.

What is claimed is:

1. A safety stop ball for use in window coverings, comprising:

a post;

a nut;

thread means defining a spiral path along which said nut travels relative to said post from an engaged position, in which said post and nut cooperate to form at least one retaining cavity for receiving and retaining an enlarged lift cord end, to a released position, wherein said post and nut are moved apart from each other to release the lift cord end.

2. A safety stop ball for use in window coverings as recited in claim 1, wherein said post defines a plurality of first cavities, said nut defines a plurality of second cavities, and, in said engaged position, said first and second cavities are aligned to form a plurality of retaining cavities.

3. A safety stop ball for use in window coverings as recited in claim 2, and further comprising a biasing means biasing said nut toward said engaged position.

4. A safety stop ball for use in window coverings as recited in claim 3, and further comprising a housing and a lid, said housing having a substantially open top which receives said lid, and a substantially closed bottom, wherein said post is fixed relative to said housing and said nut is movably received in said housing, and wherein said lid engages said nut such that pushing said lid inwardly into said housing pushes the nut toward the released position.

5. A safety stop ball for use in window coverings as recited in claim 4, wherein said biasing means is a spring substantially contained within said housing between the bottom of said housing and said nut.

6. A safety stop ball for use in window coverings as recited in claim 4, wherein said biasing means is a spring extending between the post and the nut.

7. A safety stop ball for use in window coverings as recited in claim 4, wherein said thread means includes male threads on said post and mating female threads on said nut.

8. A safety stop ball for use in window coverings as recited in claim 7, wherein said lid defines a plurality of through openings for receiving lift cords from the window covering.

9. A safety stop ball for use in window coverings as recited in claim 8, and further comprising a plurality of lift cords extending from said window covering, each of said lift cords extending through its respective through opening in said lid and having an enlarged end received in a respective retaining cavity such that, when said nut is in the engaged position, the lift cord ends are retained in their respective retaining cavities, and wherein, when the lid pushes the nut to the released position, the lift cord ends are released and pass out through said through openings.

10. A safety stop ball for use in window coverings as recited in claim 9, and further comprising a fixed lift cord permanently secured relative to said post.

11. A safety stop ball for use in window coverings, comprising:

a housing having a substantially open top and having a bottom;

a lid movably received in said open top, said lid defining a plurality of through openings;

a post fixed to the housing and extending downwardly into said housing;

a nut received in said housing, said post and nut having mating spiral threads defining a spiral path along which said nut travels from an upper, engaged position in which said nut and post cooperate to form at least one retaining cavity, to a lower, released position;

a biasing means biasing said nut toward the upper, engaged position;

at least two lift cords, each extending through its respective through opening in said lid; at least one of said lift cords having an enlarged end received in said at least one retaining cavity;

wherein said lid engages said nut such that, when said lid is pushed inwardly into said housing, it pushes said nut to said released position, releasing the enlarged lift cord end from its retaining cavity and allowing said enlarged lift cord end to pass out through its respective through opening in said lid.

* * * * *